US005380695A

United States Patent [19]

Chiang et al.

[11] Patent Number: 5,380,695

[45] Date of Patent: Jan. 10, 1995

[54] IMAGE-RECEIVING ELEMENT FOR THERMAL DYE TRANSFER METHOD

[75] Inventors: Yunn H. Chiang, Andover, Mass.; Russell A. Gaudiana, Merrimack, N.H.

[73] Assignee: Polaroid Corporation, Cambridge, Mass.

[21] Appl. No.: 231,119

[22] Filed: Apr. 22, 1994

[51] Int. Cl.[6] ..... B41M 5/035; B41M 5/38

[52] U.S. Cl. ..... 503/227; 283/75; 283/109; 428/195; 428/203; 428/204; 428/500; 428/532; 428/913

[58] Field of Search ..... 283/75, 109; 428/195, 428/203, 204, 500, 532, 913; 503/227

[56] References Cited

U.S. PATENT DOCUMENTS

| | | | |
|---|---|---|---|
| 4,653,775 | 3/1987 | Raphael et al. | 283/108 |
| 4,720,480 | 1/1988 | Ito et al. | 503/227 |
| 4,738,949 | 4/1988 | Sethi et al. | 503/227 |
| 5,261,987 | 11/1993 | Luening et al. | 156/235 |

FOREIGN PATENT DOCUMENTS

| | | | |
|---|---|---|---|
| 1427581 | 3/1976 | United Kingdom | 428/916 |
| WO8204149 | 11/1982 | WIPO | 428/916 |

*Primary Examiner*—B. Hamilton Hess
*Attorney, Agent, or Firm*—Louis G. Xiarhos

[57] ABSTRACT

An image-receiving element and a method of using same in the production of images by thermal dye transfer processing, the image-receiving element comprising a support, a polymeric security layer having a printed security layer, and an image-receiving layer for receiving dye by thermal transfer from a dye donor sheet, the polymeric security layer having cohesivity less than its adhesivity for each layer contiguous and the printed security pattern being destroyed by an attempted delamination of the image-receiving layer from the image-receiving element.

19 Claims, 4 Drawing Sheets

IMAGE-RECEIVING ELEMENT FOR THERMAL DYE TRANSFER METHOD

BACKGROUND OF THE INVENTION

This invention relates to a dye image-receiving element for use in a thermal imaging method. More particularly, it relates to an element having pre-printed security indicia and capable of receiving personalized data by a thermal dye diffusion transfer method for the production of identification documents.

In the production of images useful in the field of identification documentation, it is oftentimes desirable to embody into a document (such as an ID card, drivers license, passport or the like) data or indicia representative of the document issuer (e.g., an official seal, or the name or mark of a company or educational institution) and data or indicia representative of the document bearer (e.g., a photographic likeness, name or address). Typically, a pattern, logo or other distinctive marking representative of the document issuer will serve as a means of verifying the authenticity, genuineness or valid issuance of the document. A photographic likeness or other data or indicia personal to the bearer will validate the right of access to certain facilities or the prior authorization to engage in commercial transactions and activities.

Identification documents, such as ID cards, having printed background security patterns, designs or logos and identification data personal to the card bearer have been known and are described, for example, in U.S. Pat. No. 3,758,970, issued Sep. 18, 1973 to M. Annenberg; in Great Britain Pat. No. 1,472,581, issued to G. A. O. Gesellschaft Fur Automation Und Organisation mbH, published Mar. 10, 1976; in International Patent Application PCT/GB82/00150, published Nov. 25, 1982 as Publication No. WO 82/04149; in U.S. Pat. No. 4,653,775, issued Mar. 31, 1987 to T. Raphael, et al.; in U.S. Pat. No. 4,738,949, issued Apr. 19, 1988 to G. S. Sethi, et al.; and in U.S. Pat. No. 5,261,987, issued Nov. 16 1993 to J. W. Luening, et al.

In the aforementioned Great Britain Patent No. 1,427,581, a pre-printed photographic paper having a security-technical printed design is exposed to light, developed and fixed to provide a paper bearing the preprinted design and photographically recorded information in the form of pictures and/or data. In the aforementioned U.S. Pat. No. 4,653,775, there is described an image-receiving element (having a pre-printed security pattern) for receipt of personalized data by a photographic dye diffusion transfer ("instant") method. According to the teachings of the aforementioned International application (Patent Publication No. WO 82/04149), a paper carrying a security print or design is used as a paper base over which an image is printed in ink and/or toner in the form of a facsimile-printed graphic image.

The advent of commercial apparatus (printers) for producing dye images by thermal transfer has made relatively commonplace the production of color prints from electronic data acquired by a video camera. In general, this is accomplished by the acquisition of digital image information (electronic signals) representative of the red, green and blue content of an original, using color filters or other known means. These signals are then utilized by a printer having a plurality of small heating elements (e.g., pins) for imagewise heating of each of a series of donor sheets (respectively, carrying sublimable cyan, magenta and yellow dye). The donor sheets are brought into contact with an image-receiving element which has a layer for receiving the dyes transferred imagewise from the donor sheets. Thermal dye transfer methods as aforesaid are known and described, for example, in U.S. Pat. No. 4,621,271, issued Nov. 4, 1986 to S. Brownstein and U.S. Pat. No. 5,024,989, issued Jun. 18, 1991 to Y. H. Chiang, et al.

The application of thermal dye transfer methods to the production of identification (ID) cards, including ID cards carrying background security printing and personalized data in dye transferred by thermal diffusion processing is described in the aforementioned U.S. Pat. Nos. 4,738,949 and 5,261,987. It will be appreciated that the security of an identification document will be dependent upon the particular structure and properties of the layers and the ease with which a successful intrusion can be accomplished. In the case, for example, of the dye image-receiving element of the aforementioned U.S. Pat. No. 4,738,949, there is produced a monolithic ID card, by which is meant that the background information and the photograph or other personalized information are contained in the same layer. It is indicated in the patent (col. 2, lines 63–66) that, in this way, tampering with the photograph will destroy the background information and forgeries can be prevented.

In U.S. Pat. No. 5,261,987, reference is made to the ID cards of the aforesaid U.S. Pat. No. 4,738,949 and to the lamination of a transparent laminate (employing adhesive) onto the image-bearing surface. It is indicated that attempts to delaminate or peel apart the double composite laminate caused the thermally-transferred dye image to be lifted off the polycarbonate dye-receiver layer by virtue of the strong adhesion provided by the adhesive. It is further disclosed that, in the case of the lamination between polyvinyl chloride sheets of a support sheet carrying a polycarbonate surface having personalized and background information thereon, the incorporation of the support sheet into the ID card renders the card susceptible to being delaminated and altered. There is, thus, disclosed in U.S. Pat. No. 5,261,987 a method of increasing tamper resistance whereby personalized information is printed (by thermal dye transfer printing) onto the exposed surface of a polycarbonate receiver sheet and the polycarbonate receiving layer of the receiver element is then adhered and transferred to a cardstock material pre-printed with background information.

SUMMARY OF THE INVENTION

It is an object of the present invention to provide an image-receiving element adapted to use in a thermal dye transfer method and secure against tampering.

It is another object of the invention to provide a pre-printed image-receiving element useful in the production of an identification document, the printed information of such document being irreparably altered and destroyed upon attempted intrusion into the document by delamination.

It has been found that an image-receiving element useful in the production of an identification document by thermal dye transfer and secure against tampering can be obtained by including printed information in a polymeric layer carried on a support for such element, the polymeric layer having cohesivity less than the adhesivity of the layer for each layer contiguous thereto, and by providing thereover an image-receiving layer for receiving a dye by thermal dye transfer method.

Accordingly, in an article aspect of the present invention there is provided an image-receiving element for the production of a dye image by thermal dye transfer, the image-receiving element comprising, in order, a support sheet; a polymeric security layer having a printed security pattern; and an image-receiving layer for receiving an image in dye transferred thermally thereto from a dye donor sheet; said polymeric security layer having said printed security pattern being characterized by a cohesivity less than the adhesivity of such layer for each of said support sheet and said image-receiving layer, said printed security pattern being destroyed by an attempted delamination of said image-receiving layer from the image-receiving element.

In a method aspect, there is provided a method of preparing an identification document secure against tampering and including the steps of:

providing an image-receiving element as aforesaid;

contacting the image-receiving layer of said image-receiving element with a dye donor sheet comprising a support and a thermally transferable dye;

imagewise transferring said dye of said dye donor sheet to the image-receiving layer of said image-receiving element, thereby to provide a dye image-bearing layer; and separating said donor sheet and said image-receiving element from each other.

DETAILED DESCRIPTION OF THE INVENTION

As mentioned, the present invention involves the embodiment of pre-printed indicia into an image-receiving element suited for use in a thermal dye transfer method, the pre-printed indicia (e.g., fine-line security printing) being obliterated upon separation of the layers of the element. The manners by which a destruct mechanism can be embodied into the element, and by which security against tampering and alteration can be realized, will be better understood by reference to the description that follows.

Figure 1:
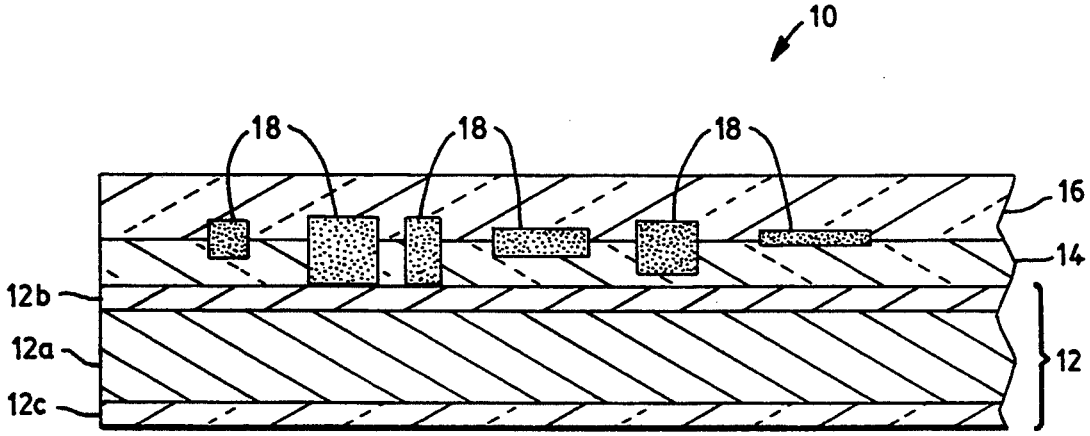
FIG. 1 is a diagrammatic cross-sectional view of an image-receiving element of the invention comprising a support, a low cohesivity polymeric layer carrying a printed security pattern, and an image-receiving layer.
Figure 3:
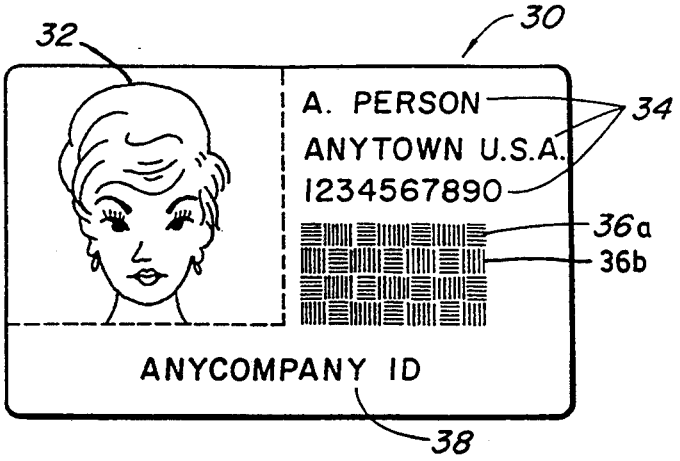
FIG. 3 is a plan view of an image-bearing print prepared from an image-receiving element of the invention, including a security pattern printed in ink, and personalized image information in dye transferred by thermal dye transfer from a dye donor sheet.

Referring to FIG. 1, there is shown a preferred image-receiving element 10 of the invention, suited to the provision of a print (such as is shown in FIG. 3) by a thermal dye transfer method. Image-receiving element 10 comprises a support sheet 12 carrying a layer 14 of low-cohesivity polymeric material onto which there is printed, by gravure, flexographic or other known printing method, a desired destructible security pattern 18. Overlaying printed layer 14 is shown an image-receiving layer 16 for receipt of thermally transferred dye.

Support sheet 12 can comprise any of a variety of sheet materials that can carry the layers shown in FIG. 1 and which can withstand the conditions of temperature and pressure typically encountered in thermal dye transfer methods and apparatus. Suitable supports can be rigid or flexible sheet materials which provide mechanical strength to the image-receiving element and print made therefrom. Support 12 can comprise transparent, opaque or translucent material, reflective (opaque) supports being preferred for the production of identification documents such as ID cards where image data is viewed against an opaque (e.g., white) background. Examples of transparent supports include polyesters, such as polyethylene glycol terephthalate; polycarbonates; polystyrenes; cellulose esters such as cellulose acetate, triacetate, nitrate, propionate, butyrate, acetate-propionate or acetate-butyrate; polyolefins, polysulfones and polyimides. Reflective supports useful in image-receiving element 10 include cellulose paper, polyester-coated cellulose paper, polymer-coated cellulose paper, e.g., polyethylene- or polypropylene-coated paper, coated or uncoated wood-free paper, synthetic paper, and plastic films which carry a layer of reflective pigment or which include a filler, e.g., polyethylene terephthalate containing calcium carbonate or titanium dioxide.

Among useful supports are polyester films made opaque by the presence of voids, commercially available under the Melinex tradename from Imperial Chemical Industries (ICI) Films, England; and synthetic paper materials comprising filled polyolefinic material, commercially available under the Teslin tradename, from PPG Industries, Pittsburgh, Pa.

A preferred support sheet 12 is a paper carrying pigmented (e.g., titanium dioxide) polymeric cladding material. Such a support is shown in FIG. 1, wherein **12*a* is an opaque (reflective) paper core of cellulosic material (e.g., fiber) and each of 12*b* and 12*e* comprises a polymeric cladding material such as polyethylene. Preferably, layer 12*b* will include a reflective pigment such as titanium dioxide. Such a support provides good durability and flexibility and provides a white reflective background especially suited to the production of ID cards. In addition, a low cohesivity layer 14 can be adhered readily to the polymeric cladding layer 12b of support 12**.

Polymeric security layer 14 comprises an essential layer of image-receiving element 10 and provides a destruct feature which makes readily apparent an attempted intrusion into the element by delamination. Layer 14 comprises a polymeric material which can be adhered to support 12 and to which can be adhered overlying image-receiving layer 16. In addition, layer 14 must be capable of accepting printing ink 18 from aqueous or organic solvent-coated formulations, to provide a desired security pattern. An important characteristic of polymeric layer 14 is its cohesivity in relation to its adhesivity for layers contiguous thereto. Thus, layer 14 will comprise a polymeric material having a cohesivity less than the adhesivity for each of layers 12b and 16.

Figure 4:
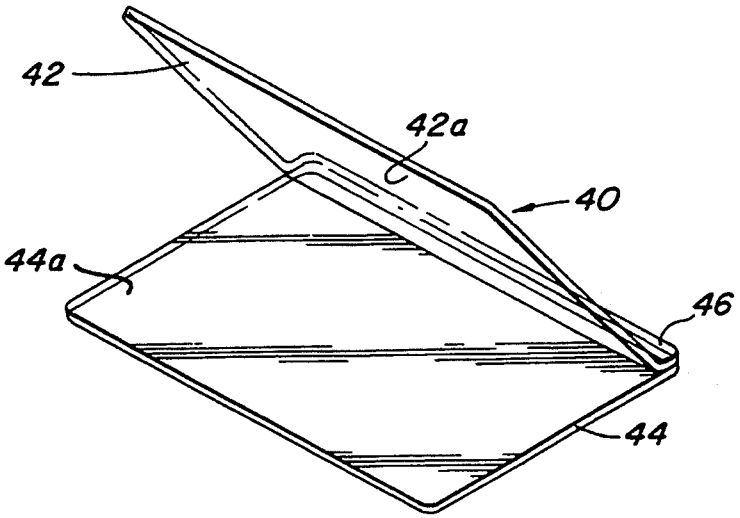
FIG. 4 is a perspective view of a protective pouch or envelope for receiving the image-bearing print of FIG. 3, and upon lamination, for producing a laminated and secure identification document.
Figure 5:
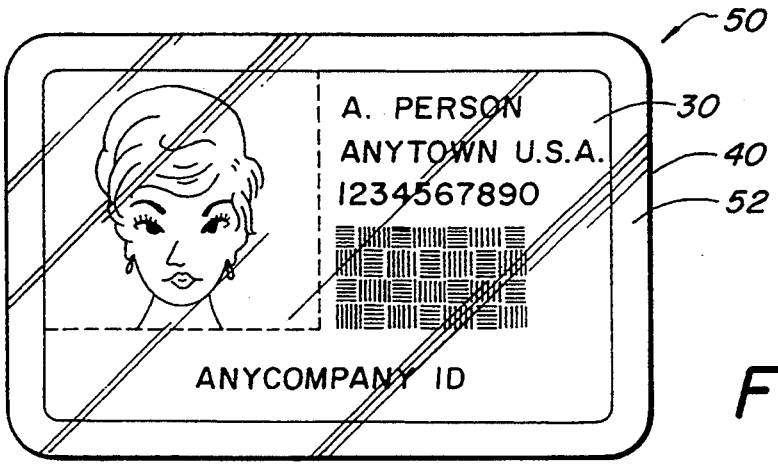
FIG. 5 is a plan view of an assembled ID card prepared from the image-bearing print and protective pouch shown, respectively, in FIGS. 3 and 4.
Figure 6C:
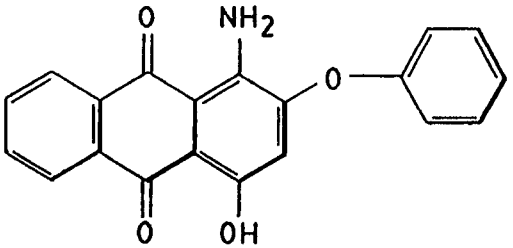
FIGS. 6A–6D show the chemical formulae of the dyes used in the Examples below.
Figure 6D:
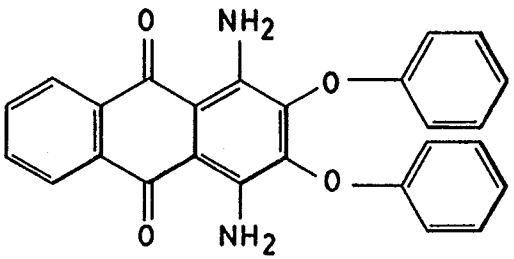
Figure 6A:
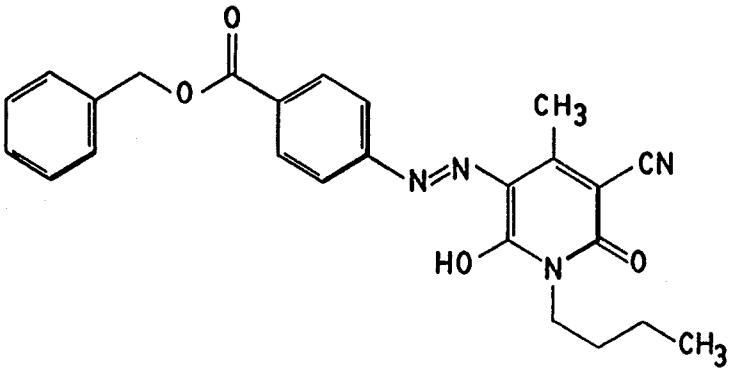
Figure 6B:
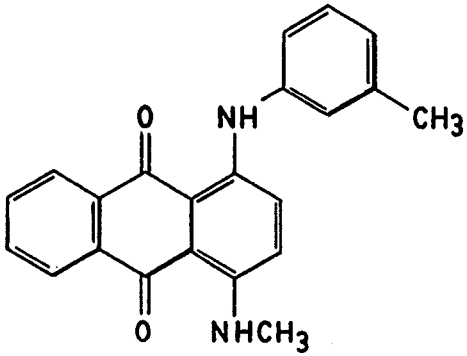
Figure 7:
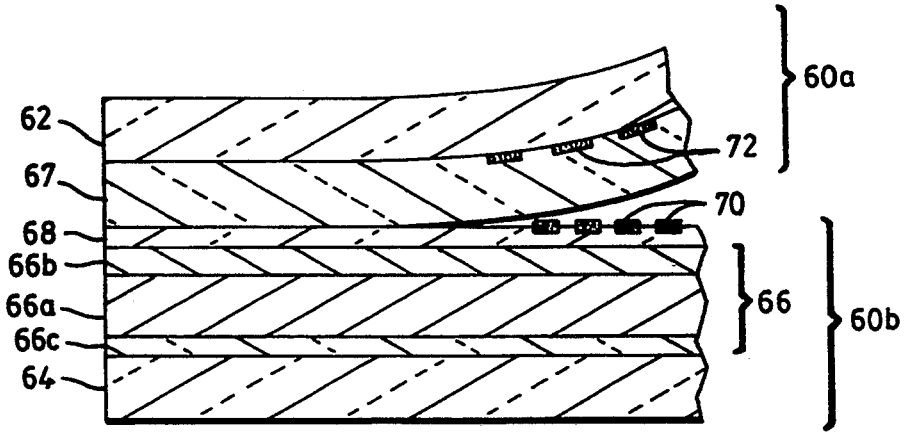
FIG. 7 is a diagrammatic cross-sectional view of an undesirable delamination of an image-bearing print laminated between protective sheets, the print embodying a pre-printed ink security pattern and a thermally transferred dye image, the dye image being removed upon delamination, to bare a re-usable element carrying the ink security pattern.

Typically, in the production of an identification document from a print, such as is shown in FIG. 3, protection of the image surface of the print will be afforded by the lamination thereto of a transparent protective coating or plastic overlay. A print can be heat sealed, for example, inside a protective pouch or envelope (as is shown in FIG. 4) to provide an ID card such as is shown in FIG. 5. It will be appreciated that a protective sheet of plastic adhered to and overlying the image surface of the print, can be grasped in an effort to initiate and propagate a separation of the layers of the document. The manner in which such layers separate (or delaminate) will influence greatly the security of the card or document. Thus, there is shown in FIG. 7, in a state of partial delamination, an ID card 60 which, in contrast to identification documents made according to the present invention, undergoes a particularly disadvantageous delamination which produces a re-usable element 60b. ID card 60 comprises a print (comprising paper core 66; polymeric cladding layer 66c; reflective polymeric cladding layer 66b; polymeric ink-receptive layer 68 carrying printed indicia 70; and dye receiving layer 67 bearing thermally transferred dye image information 72) encased by heat lamination between plastic protective sheets 62 and 64.

In the case of the ID card 60 of FIG. 7, upon grasping of the protective sheets 62 and 64 and initiating and propagating a delamination of the sheets, there is effected a separation of the dye image data 72 (typically, information personal to the cardholder) from the background printed data 70 (typically, representative of a card-issuing authority). This is effected by separation into elements 60a and 60b. It will be appreciated that element 60b could be re-used, and a fraudulent card prepared, by laminating a transparency bearing an image personal to one other than the authorized cardholder onto element 60b carrying the printed data of a validly issued card.

Figure 2:
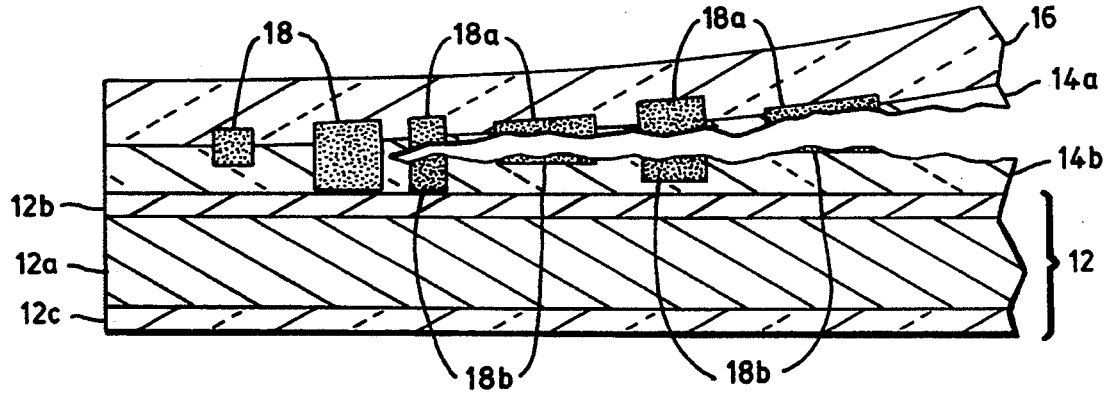
FIG. 2 is a diagrammatic cross-sectional view of the image-receiving element of FIG. 1, partially delaminated and showing portions of the printed security pattern partitioned to the separated components of the image-receiving element.

In contrast to the aforesaid unacceptable delamination mode, the image-receiving element 10 of the invention is designed to fracture cohesively within polymeric layer 14, such that, pre-printed ink indicia 18 are partitioned between portions of layer 14 adhered to layer 16 after delamination and those portions of layer 14 remaining adhered to support 12. Thus, there is shown in FIG. 2, an image-receiving element 10 in a partial state of delamination. Portions 14a of layer 14 are shown adhered to image-receiving layer 16. Portions 14b of layer 14 are shown adhered to layer 12b of support 12. Portions 18a of indicia 18 are shown in portion 14a of layer 14; corresponding indicia portions 18b remain with portion 14b of cohesively failed layer 14. Proper registration of the torn-apart components of image-receiving element 10, in a manner to conceal the delamination, is not possible. A measure of security against tampering and alteration is, thus, provided by the partitioning shown in FIG. 2.

A variety of polymeric materials that can form a cohesively failable layer can be used in security layer 14 for receiving printed indicia 18. Among useful materials are adhesives such as poly(ethylene-co-ethylaerylate); poly(ethylene-co-methacrylic acid); poly(methylmethacrylate-co-n-butylmethacrylate); poly(methylmethacrylate-co-ethylmethacrylate); polyesters of aliphatic or aromatic dicarboxylic acids (or their lower alkyl esters) with polyols such as ethylene glycol and 1, 4-butanediol; polyurethanes obtained from aliphatic polyols, aromatic diisocyanates and a chain-extending agent.

Suitable polymeric materials for use as a polymeric security layer in article 10, and the cohesivity of such materials, can be assessed by resort to simple tape-test methods, using commercially available adhesive tapes. For example, a test candidate polymeric material can be coated onto a substrate, such as the white-pigmented sheet support described in EXAMPLE 3 hereof. A razor cut is made into the surface of the coated polymeric layer and an adhesive tape is placed orthogonally across the cut, secured fixedly and peeled away, in the manner described in EXAMPLE 4 hereof. A series of tapes, each of which applies a varying degree of adhesion to the coated surface, can be used to indicate qualitatively the amount of force which needs to be exceeded in order to cause a desired cohesive failure of the coating. In other words, the cohesivity of the security layer must be less that the cohesivity of all the layers in an imaging system and less than the adhesivity of all the interfaces in the system. A useful qualitative test of the cohesivity of a security polymer layer may be achieved by the adhesivity provided by Scotch TM Brand Magic TM Tape 810 (3M Company), and which fails adhesively and Scotch TM Brand Ruby tape (3M Company) which causes the security layer to fail cohesively.

A suitable layer 14 of cohesively fracturable polymeric material can be deposited from an aqueous or organic solvent, the choice of solvent being dependent upon the nature of the layer onto which layer 14 is deposited and the nature of layer 16 to be deposited over layer 14. Latex compositions containing polymeric material for layer 14 can be employed. Commercially available lattices of styrenated acrylic emulsion can be used with good results, including those available from Rohm & Haas Co., Cherry Hill, N.J. under the Unocal 78 tradename as Resin 1302; and Unocal 76 Resins 1019 and 1310. Unocal 76 Resin 6213, a vinylacetate homopolymer, can also be employed with good results.

Printed indicia 18 can be applied onto polymeric layer 14 using known printing methods. Typically, indicia 18 will be formed by applying, printing or drawing a paint or ink composition having a binding agent and a patterning agent (e.g., pigment or ink) onto polymeric layer 14. Brush painting, spatula painting, roll-coating, gravure printing, offset printing, relief printing and transfer printing methods can be used, depending upon the nature the pattern desirably employed, and especially, on the intricacy or fineness of the pattern. The nature of the binder of the printing formulation and of the particular patterning agent will also vary depending upon the nature of the contiguous layers 14 and 16 between which the pattern is to be incorporated.

Printed pattern 18 can be incorporated into element 10 in the form of characters or signs or a floral or other fanciful or decorative design. An official design or logo, or a name or phrase associated, for example, with the issuing authority can be used. An added degree of security can be accomplished by applying pattern 18 in an ordered arrangement having a tightly-printed pattern, i.e., having a plurality of finely-divided printed and unprinted areas in close proximity to one another. A preferred pattern 18 is a fine-line printed security pattern such as is used in the printing of banknote paper, stock certificates and the like and can take the form of fine-line printing in filigree or guilloche design.

As shown in FIG. 3, pre-printed security indicia 36*a*, 36*b* and 38 occupy only a portion of the background of print 30. Such indicia can, however, occupy a proportionally greater part of the area. Thus, a pattern such as is illustrated by indicia 36*a* and 36*b* can occupy the greatest part of the background of an ID card and a suitable ink for such purpose can be selected so as not to obscure overlying data to be incorporated into layer 16 by thermal dye transfer. If desired, indicia 36*a* and 36*b* can be part of different pattern designs and can be printed in different inks, for example, in UV-fluorescent and visible-color ink, respectively.

The binder used in a printing composition for printing indicia 18 onto polymeric layer 14 is a binder which has adhesivity for the polymeric materials of each of layers 14 and 16 and which can permeate or diffuse partially into layer 14. As is shown in FIGS. 1 and 2, indicia 18 are permeated to varying depths into layer 14. Adhesion of the binder and indicia to the polymeric material of layer 14 and to the overlying polymeric material of image-receiving layer 16 permits the cohesive failure of indicia 18 along with the cohesive failure of layer 14.

Layer 14 can include various additives, to increase or decrease adhesivity to either of the layers contiguous thereto or to modify the softening point or the hardness of the layer. If desired, inorganic filler, e.g., silica, or polymeric latex or other particles can be included in layer 14 to reduce cohesivity of the layer and to promote cohesive failure in a predetermined and desired manner.

If desired, security layer 14 can be incorporated into image-receiving element 10 in the form of dual layers. An additional layer (not shown) of polymeric material used for providing security layer 14 of article 10 can be coated over the security printed indicia 18 printed onto layer 14, to thereby encase the security printed indicia within the dual composited layers. Preferably, such additional layer will comprise the same polymeric material as is used in layer 14.

The binding agent of a printing ink formulation suited to the production of indicia 18 can comprise any of a variety of polymers, including homopolymers and copolymers, such as polyvinylacetate; poly(acrylic acid-co-methyl-methacrylate); polyvinyl alcohol; polyvinyl butyral; polyester and polyamide resins; hydroxyethyl cellulose; hydroxypropyl cellulose and carboxymethyl cellulose.

The patterning agent can vary with the desired pattern and can comprise any of a variety of coloring agents used in the printing arts. The patterning agent should, however, be compatible with the binder employed therewith and should be dispersible therein so that the resulting formulation can be applied by one of the methods previously described. If desired, the pattering agent can be comprised of material which provides a visible colored pattern or design or one which forms an invisible pattern, such as a fluorescent pigment that becomes visible when examined under a source of ultraviolet light or machine-readable pattern, e.g., a bar-code pattern, in IR-absorbing dye. There can be used as the pattering agent, known coloring agents including inorganic pigments or organic dyes or pigments. Suitable pattering agents include such inorganic pigments as calcium carbonate, barium sulfate, titanium dioxide, carbon black, yellow lead, bismuth oxychloride, chromium vermilion, cadmium red, navy blue, ultramarine or iron oxide or such organic dyes or pigments, as dyes or pigments of the azo class, vat series dyes or pigments, phthalocyanine, triphenylmethane series dyes, quinacrydone series pigments, perylene dyes and the like.

The desired security pattern of indicia 18 can vary in thickness and in width. Depending on the nature of the printing composition (especially the binder thereof) the depth of diffusion or penetration into layer 14 can vary. Typically, the thickness of the printed pattern will be in the range of from 0.5 to 4$\mu$, and preferably, 1 to 2$\mu$. Coverage can vary and a tightly printed pattern of fine lines will be preferred from the standpoint of security, i.e., difficulty in reproducing an intricate pattern.

Depending upon the nature of the binding agent and the nature of the polymer material of image-receiving layer 16 to be applied over printed layer 14, higher coverages and thicknesses of printed indicia 18 may lessen the adhesion of image-receiving layer 16 to polymeric layer 14. Accordingly, the selected pattern, and the coverage and thickness thereof, should be employed in a manner to permit good adhesion of image-receiving layer 16 to polymeric layer 14 and thereby permit a cohesive failure in polymeric layer 14 upon attempted delamination of the layers of the image-receiving element 10.

Image-receiving layer 18 for receiving dye transferred thermally from a dye donor sheet can comprise any of a variety of polymers hitherto used in receiving sheets for use in thermal dye transfer methods. For example, a polyester, polyacrylate, polycarbonate, polyvinylacetate, polyacrylonitrile, poly(styrene-co-methylmethacrylate), poly(styrene-co-acrylonitrile), polyurethane, polyamide and polyvinyl chloride can be used. If desired, there can be used as a replacement, in whole or in part, for any of the aforementioned polymeric image-receiving materials, a liquid crystal material, such as is disclosed and claimed in U.S. Pat. No. 5,024,989 (issued Jun. 18, 1991 to Y. H. Chiang, et al.).

A preferred image-receiving polymer is a polyvinyl chloride resin which can be applied over polymeric layer 14 using methylene chloride or other known organic solvent. Good results are obtained using a commercially available polyvinyl chloride resin available from Occidental Chemical Corp., Berwyn, Pa., under the designation Polyvinyl Chloride 160.

A polyvinyl chloride image-receiving layer 16 permits the realization of good dye densities and is especially suited to the production of good heat-lamination bonding to a preferred polyvinyl chloride protective sheet material. Polyvinyl chloride is also preferred as an image-receiving layer from the standpoint of its use in thermal dye imaging methods with freedom from undesired sticking to dye donor sheets. Other image-receiving layer materials, especially useful from the standpoint of non-sticking properties, are described in the copending application of Howard G. Schild, U.S. Ser. No. 07/801,460, filed Dec. 2, 1991 for Sheet Material For Thermal Transfer Imaging.

In applying image-receiving layer 16 onto printed layer 14, a suitable solvent therefor will be one which does not dissolve, swell or otherwise affect layer 14 adversely. In particular, solvent for image-receiving layer 16 which dissolves or causes bleeding of ink-pattern 18 should be avoided. Good results are obtained using an aqueous ink for the application of printed indicia 18 onto polymeric layer 14 followed by application of image-receiving layer 16 from a solvent which does not dissolve or otherwise affect layer 14.

The utilization in image-receiving element 10 of separate polymeric security and image-receiving layers 14 and 16, respectively, provides important benefits and stands in contrast to the alternative of using a single layer to receive both security-printed indicia and dye-image data transferred from a dye donor sheet. The printing of an ink pattern onto a polymeric image-receiving layer (particularly, a pattern of high coverage and/or thickness) can affect adversely the capacity of the layer to receive fixedly a thermally transferable dye, depending upon the particular dye and depending on the nature of the image-receiving layer and the characteristics of the printing ink composition, and especially the binder thereof.

Utilization of a single layer promotes the incidence of dye smudging and rub-off owing to interference by the printed indicia with the fixation of the transferred dye to the image-receiving layer. Importantly, inadequate fixation (adhesion) of dye to the image-receiving layer facilitates removal of the dye-imaged data from the printed security (background) data, accomplished with the aid of an adhesive sheet. Similarly, the printed pattern can promote undesired sticking to a heated dye donor sheet during image processing, thereby preventing clean and efficient separation of the image receptor and dye donor sheets.

The provision, in contrast, of an image-receiving layer 16 overlying printed security layer 14 isolates effectively the printed pattern from the path of thermal dye diffusion, i.e., the path of dye from the dye donor sheet into the image receptor. Degrees of latitude are, thus, possible in choice of printing ink formulation and print-pattern coverage and in the choice of polymeric materials that can be employed suitably as an image-receiving layer. Such isolation negates also the detrimental sticking of printed pattern material to a dye donor sheet. It has been found that image-receiving layer 16, in overlying relation to printed security layer 14, can be imaged readily, i.e., imagewise dyed with good results, and can be separated cleanly from a heated dye donor sheet, using commercially available dye donor sheets and thermal imaging printer apparatus.

The image-receiving element of FIG. 1 can be used for the production of a photograph or print 30, shown in FIG. 3. Print 30 can be produced using dye donor sheets and thermal dye transfer methods and apparatus well known in the art. A suitable method is shown schematically in FIG. 8 and is described hereinafter. As shown in FIG. 3, ID photograph or print 30 includes personal data 34 and the likeness 32 of the bearer, resulting from the thermal transfer of dye from a dye donor sheet. Indicia **36*a* and 36*b* are indicia printed in ink to provide a background pattern. Preferably, background indicia 36a and 36b will appear in close proximity to personal indicia 34 so that an attempt at alteration of personal indicia will obliterate printed indicia 36*a* and 36*b* or otherwise make apparent the attempted alteration. Indicia 38 representative of the ID card issuer form part of the background data viewed with the personalized indicia. If desired, printed information in the form of a corporate logo or the name of a manufacturer or distributor of image-receiving elements 10 or photographs or prints 30 can be incorporated into image-receiving element 10** to indicate origination from a qualified supplier of such elements or photographs or prints.

Using an image-receiving element of the invention (such as is shown in FIG. 1 ) and a dye donor sheet (such as is known in the art), a photograph or print (such as print 30 of FIG. 3) can be obtained. Donor sheets useful for providing such a print are those commonly used in thermal dye diffusion transfer imaging systems. In systems of this type the image-forming material of the donor sheet is a dye. The dyes that can be used in the present process can be any of those used in prior art thermal diffusion or sublimation transfer processes. Typically, such a dye is a heat-sublimable dye having a molecular weight of the order of about 150 to 800, preferably 350 to 700. In choosing a specific dye for a particular application, it may be necessary to take account of factors such as heat sublimation temperature, chromaticity, compatibility with any binder used in the donor sheet and compatibility with any image-receiving materials on the receiving sheet. Specific dyes previously found to be useful include:

- Color Index (C.I.) Yellows Nos. 3, 7, 23, 51, 54, 60 and 79;
- C.I. Disperse Blues Nos. 14, 19, 24, 26, 56, 72, 87, 154, 165, 287, 301, and 334;
- C.I. Disperse Reds Nos. 1, 59, 60, 73, 135, 146 and 167;
- C.I. Disperse Violets Nos. 4, 13, 31, 36 and 56;
- C.I. Solvent Violet No. 13;
- C.I. Solvent Black No. 3;
- C.I. Solvent Green No. 3;
- C.I. Solvent Yellows Nos. 14, 16, 29 and 56;
- C.I. Solvent Blues Nos. 11, 35, 36, 49, 50 63, 97, 70, 105 and 111; and
- C.I. Solvent Reds Nos. 18, 19, 23, 24, 25, 81,135, 143, 146 and 182.

One specific set of dyes which have been found to give good results in a three-color thermal imaging process of the present invention are:

- Yellow C.I. Disperse Yellow No. 23 1, also known as Foron Brilliant Yellow S-6GL;
- Cyan C.I. Solvent Blue No. 63, C.I. No. 61520, 1-(3'-methylphenyl)amino-4-methylaminoanthraquinone;
- Magenta A [mixture of approximately equal amounts of C.I. Disperse Red No. 60, C.I. No. 60756, 1-amino-2-phenoxy-4-hydroxyanthraquinone and C.I. Disperse Violet No. 26, C.I. No. 62025, 1,4-diamino-2,3-diphenoxyanthraquinone ].

Donor sheets useful for the practice of the present invention typically have a layer of image-forming material disposed on one face of the sheet, the layer comprising the image-forming material and a binder for the image-forming material. During thermal imaging, the layer of image-forming material on the donor sheet faces image-receiving layer 16 of image-receiving element 10. The donor sheet support may be paper, for example, condenser paper, or a plastic film, for example, an aromatic polyamide film, a polyester film, a polystyrene film, a polysulfone film, a polyimide film or a polyvinyl film. The thickness of the support is usually in the range of about 2 to about 10μ, although it is desirable to keep the thickness of the support in the range of about 4 to about 7μ, since a thick support delays heat transfer from the printing head to the dye and may affect the resolution of the image produced. A donor sheet having a 6μpolyethylene terephthalate support has been found to give good results in the present process.

The binder for the image-forming material carried on the donor sheet serves to keep the image-forming material dispersed uniformly and to prevent transfer or bleeding of the relatively low molecular weight image-forming material except where the donor sheet is heated during the thermal imaging process. Binders for the image-forming material include cellulose resins, such as ethyl-cellulose, hydroxyethylcellulose, ethylhydroxyethylcellulose, hydroxypropylcellulose, cellulose acetate, and cellulose acetate butyrate and vinyl resins, such as, polyvinyl alcohol, polyvinyl pyrrolidone, polyvinyl acetate, and vinyl alcohol/vinyl butyral copolymers; polyacrylamide resins, and acrylic acid resins, such as, poly(methyl methacrylate). Preferred binders are poly(methyl methacrylate) and vinyl alcohol/vinyl butyral copolymers.

Desirably the weight ratio of dye to binder is in the range of from about 0.3:1 to about 2.55:1, preferably about 0.55:1 to about 1.5:1.

A layer of a lubricating agent will oftentimes be present on the back of the donor sheet remote from the dye layer, the lubricating agent serving to reduce adhesion of a thermal printing head to the donor sheet. Such a layer of lubricating agent (also called "heat-resistant slipping layers"), and methods for its creation on a donor sheet are described in detail in the aforementioned U.S. Pat. No. 4,720,480; and hence, such lubricating agents will not be described in detail herein. A preferred lubricating agent comprises (a) a reaction product between polyvinyl butyral and an isocyanate; (b) an alkali metal salt or an alkaline earth metal salt of a phosphoric acid ester; and (c) a filler. This lubricating agent may also comprise a phosphoric acid ester free of salts.

The filler used in this preferred lubricating agent can be an inorganic or organic filler having heat resistance, for example, clay, talc, a zeolite, an aluminosilicate, calcium carbonate, polytetrafluoro- ethylene powder, zinc oxide, titanium oxide, magnesium oxide, silica and carbon.

Because it is desirable to keep the donor sheet thin, the thickness of the lubricating layer preferably does not exceed about 5μ.

Also useful in the preparation of secure identification documents utilizing the teachings of the present invention are those known donor sheets which utilize in-situ dye generation to form images. In systems of this type, the image-forming material in the donor sheet is a material which, upon application of heat, transfers to the receiver sheet. The transferred image-forming component combines with a material already present in the receiver sheet to generate the desired color. Such systems are described, e.g., in U.S. Pat. No. 4,824,822 and 5,011,811.

The thermal imaging process of the present invention is carried out in accordance with image information by means of a thermal printhead, laser beams or the like. Generally, information representative of the bearer of an ID card or other identification document will be acquired and stored on magnetic or other media. Retrieval of the information and imagewise actuation of the printhead heater elements (or lasers) using electrical signals representative of such information permits the production of a desired photograph or print.

As mentioned previously, in forming an ID card it is common practice to seal the information document between two sheets of protective material. A favored structure for fully protecting the front and rear surfaces of an ID photograph comprises an envelope-type pouch such as is shown in FIG. 4. In pouch 40, is shown front plastic sheet member 42 which is coupled to rear plastic sheet member 44 along edge 46, usually by an adhesive bond. Pouch 40 will typically have dimensions slightly greater than those of the ID photograph, so that the peripheral edges of the front and rear protective members can be sealed together during a heat and/or pressure lamination. Preferred materials for use as protective sheet members 42 and 44 include rigid or semirigid vinyl, e.g., the polyvinyl chloride or polyvinyl chloride/polyvinyl acetate copolymers known in the art. Polyester and other sheet materials can also be employed, preferably, with an adhesive to promote good bonding.

Following positioning of ID photograph 30 of FIG. 3 between the protective sheet elements of pouch 40 (FIG. 4), the structure can be laminated, as by heat sealing to provide a finished ID card 50, shown in FIG. 5. As shown in FIG. 5, photograph 30 is centered in pouch 40 which defines a border 52 around the photograph.

The following examples are provided to further illustrate the invention. It will be understood that the examples are intended to be illustrative and not limiting in nature. All parts and percentages are by weight unless otherwise specified.

EXAMPLE 1

This Example illustrates the production of an ultraviolet (UV) printing ink composition useful for the production of an image which, upon exposure to ultraviolet radiation, fluoresces at a wavelength of 360 nm.

Into a Waring blender were added ten parts hydroxypropyl cellulose (Klucel E, Aqualon Co., Wilmington, Del.); 45 parts isopropanol; and 45 parts butanol. The ingredients were blended at medium speed for 15 minutes, to provide a mix identified as Part A.

A mixture (Part B) was obtained by placing into a ball mill and milling for 24 hours, the following ingredients:

| Ingredient | Parts by Weight |
|---|---|
| Klucel E | 10 |
| Isopropanol | 45 |
| Butanol | 45 |
| Cartex CXDP (oxazinone UV dye, Sandoz Chemicals, Charlotte, NC) | 45 |

Equal weight portions of the Part A and Part B mixes described above were blended in a Waring blender at medium speed to provide a composition for the provision of a printed UV security pattern.

EXAMPLE 2

This Example illustrates the production of a blue printing ink composition.

Using the procedure described in EXAMPLE 2, and substituting Gemglo 291 Blue ink (Sun Chemical Corp., Carlstadt, N.J.) for the Cartex CXDP in Part B thereof, a blue ink composition suited to the printing of a blue security pattern was obtained.

EXAMPLE 3

This Example illustrates the production of a preprinted image-receiving element for use in a thermal dye transfer method.

An opaque white-pigmented sheet material having a thickness of about eight mils (0.20 mm) was used as the sheet support for an image-receiving element. The sheet was a high strength paper comprising a core of about 0.10 mm thick of cellulosic fiber having on each side of the core, a layer of titanium dioxide-pigmented polyethylene, each of a thickness of about 0.10 mm. Onto the pigmented support sheet material was coated a layer of styrenated acrylic emulsion (Rohm & Haas Company, Cherry Hill, N.J.) which, after drying, provided a layer of about 00 microns thickness. Onto the resulting polymeric layer, a security pattern was printed using the UV fluorescent ink composition prepared as described in EXAMPLE 1. The composition was printed onto the surface of the layer in the form of a star pattern, using a gravure cylinder with a 200-line screen. The security ink pattern was dried by passing the coated sheet material through a drying oven.

Onto the polymeric layer carrying the aforedescribed UV-ink pattern, there was applied a blue wavy-line security pattern, using the blue ink composition prepared as described in EXAMPLE 2. The pattern was applied using a gravure cylinder, and after oven drying, there was provided a fine-line pattern having lines of approximately four mm width.

Over the UV- and blue ink-printed polymeric layer, there was coated a layer of polyvinyl chloride coated from a 00-% solution of Polyvinyl Chloride 160 (Occidental Chemical Corp., Berwyn, Pa.) in methylene chloride. The coating was dried to an image-receiving layer having a thickness of four to five microns.

EXAMPLE 4

This Example illustrates the use of an image-receiving element of the present invention in a thermal dye sublimation transfer method.

Figure 8:
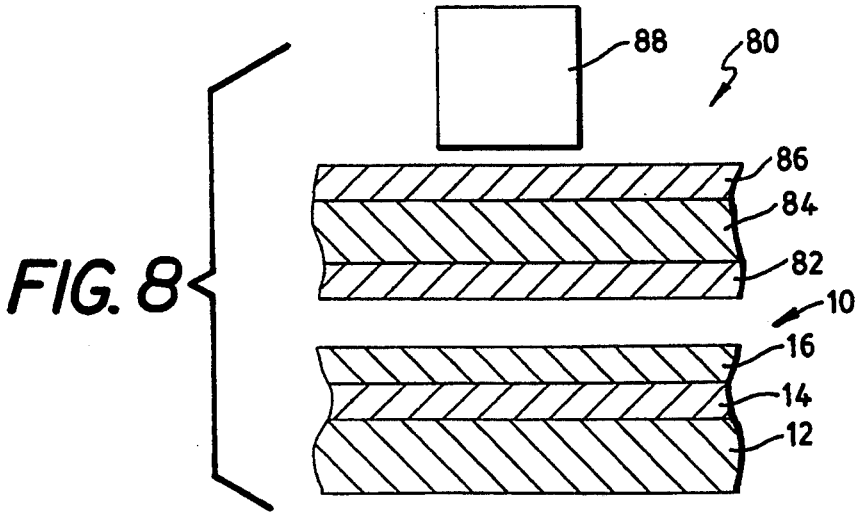
FIG. 8 is a schematic cross-section through a dye donor sheet and an image-receiving element being used in a thermal dye transfer method of the invention.

FIG. 8 of the accompanying drawings shows schematically a thermal imaging method of the present invention in progress. As shown in FIG. 8, a thermal printing head 88 heats selected portions of a donor sheet (generally designated 80), thereby transferring dye imagewise from the donor sheet 80 to an image-receiving element of the invention (generally designated 10) to form an image thereon. (For ease of illustration, the donor sheet 80 and receiving sheet 10 are shown spaced apart in FIG. 8; in practice, the two sheets are of course pressed into contact with one another by the printing head 88 during thermal imaging processing.)

The donor sheet shown in FIG. 8 is a commercially available material, being those sold by Hitachi, Ltd., Tokyo, Japan, for use with its VY-100A printer, although the donor sheet 80 is manufactured by Dai Nippon Insatsu Kabushiki Kaisha, of Japan. This primer uses a thermal imaging method to provide a color print of an image recorded on a magnetic medium and/or displayed on a video monitor.

According to the manufacturers, the donor sheet 80 comprises a support layer 84 of terephthalate polyester 10μ in thickness. One side of support 84 carries a lubricating layer 86, of 5μ thickness. The lubricating layer comprises a resin which softens at about 229° C. and which contains particles of calcium carbonate 1 to 5μ in size. The opposed face of the support layer 84 carries a dye layer 86. This dye layer 86 is 2 to 5μ in thickness and comprises a dye dispersed in a vinyl alcohol/vinyl butyral copolymer, which softens at 85° C. and serves as a binder for the dye.

The donor sheet 80 is supplied commercially in a cartridge generally similar in form to a conventional 110 or 126 film cartridge, but substantially larger since the donor sheet 80 is approximately 4 inches (102 mm.) wide. The donor sheet cartridge comprises a feed spool and a take-up spool, the two spools having parallel axes and each being disposed within a substantially lightproof, cylindrical, synthetic resin housing. The opposed ends of the two cylindrical housings are interconnected by a pair of parallel rails, so leaving between the two housings an open rectangular frame in which a single pane of the donor sheet 80 can be exposed.

In the commercial cartridge, the donor sheet 80 is in the form of a long roll comprising a plurality of panes, each pane containing a single color dye, with yellow, cyan and magenta panes being repeated cyclically along the film so that each triplet of three panes contains one pane of each color. One triplet of three panes is used for each print. The dyes used are as follows:

Yellow

C.I. Disperse Yellow No. 23 1, also known as Foron Brilliant Yellow S-6GL;

Cyan

C.I. Solvent Blue No. 63, C.I. No. 61520, 1-(3'-methylphenyl)amino-4-methylaminoanthraquinone;

Magenta

A mixture of approximately equal amounts of C.I. Disperse Red No. 60, C.I. No.60756, 1-amino-2-phenoxy-4-hydroxyanthraquinone, and C.I. Disperse Violet No. 26, C.I. No. 62025, 1,4-diamino-2,3-diphenoxyanthraquinone.

The formulae of these preferred dyes are shown in FIGS. 6A–6D of the accompanying drawings. The dyes sublime at 140°–142° C.

The image-receiving element 10 shown in FIG. 8 comprises the image-receiving element of EXAMPLE 3 and includes reflective support 12, layer 14 of low-cohesivity adhesive carrying security printing (not shown) and image-receiving layer 16.

The image-receiving element of EXAMPLE 3 was used with the donor sheet 80 in a Hitachi VY-100A printer to produce color reflection prints (approximately 78×97 mm) having a nominal resolution of 150 lines per inch (i.e., the pixel array was 468 by 512 pixels) with a 64 grey tone scale using a power level of 120 watts and a printing time of 80 seconds per print. The original used for the experiment was a test pattern having a nine-step (including white and black areas) grey tone scale and areas of seven differing colors. Measurements of the total visual optical density, and cyan, magenta and yellow optical densities of each of the grey and colored areas, together with measurements of the background reflectance density were made by an X-Rite 338 photographic densitometer.

TABLE 1

| Visual | Cyan | Magenta | Yellow |
|---|---|---|---|
| Grey scale | | | |
| 0.10 | 0.10 | 0.09 | 0.07 |
| (Background) | | | |
| 0.19 | 0.16 | 0.22 | 0.21 |
| 0.49 | 0.43 | 0.58 | 0.57 |
| 0.89 | 0.83 | 1.03 | 1.01 |
| 1.41 | 1.37 | 1.58 | 1.57 |
| Colored areas | | | |
| Black | | | |
| 2.62 | 2.72 | 2.58 | 2.89 |
| Blue | | | |
| 2.48 | 2.62 | 2.43 | 1.12 |
| Red | | | |
| 0.88 | 0.23 | 2.42 | 2.75 |
| Magenta | | | |
| 1.12 | 2.83 | 0.26 | 1.02 |
| Green | | | |
| 1.30 | 2.60 | 0.78 | 2.49 |
| Cyan | | | |
| 1.17 | 0.86 | 2.84 | 0.49 |
| Yellow | | | |
| 0.12 | 0.13 | 0.12 | 2.30 |

A thin-line razor cut of approximately 50 mm in length was made into the image area of a print obtained in the manner described in EXAMPLE 4. A four-inch (ten cm) length of 2.54 cm-wide tape (Scotch TM brand Red Lithographers Tape 616, 3M Company) was placed orthogonally across the cut and pressed to secure the tape firmly to the image surface, a short terminal portion being reserved for grasping. In an attempt to remove the image-receiving layer (and any additional layers) from the print, the tape was grasped and pulled slowly toward and past the cut, until removed from the image surface. Both the tape and the area of the print subjected to the tape test were then examined using a stereo microscope at low magnification (5×) under ultraviolet light (360 nm, Ultra-Violet, Inc., Model UVL-21). The examination revealed the presence of UV printing ink on the removed tape and on the print in the region thereof subjected to the tape test. The test confirmed a partitioning of UV ink between the separated elements of the print indicating a cohesivity of the styrenated acrylic layer less than the adhesive strength to the image-receiving layer and to the support.

Since certain changes may be made in the aforedescribed embodiments of the present invention without departing from the scope of the invention herein involved, it is intended that all matter contained in the above described shall be interpreted as illustrative and not in a limiting sense.

What is claimed is:

1. An image-receiving element for the production of a dye image by thermal dye transfer, the image-receiving element comprising in order:

a support sheet;

a polymeric cohesively destructible security layer having a printed security pattern comprising a patterning agent and a binder therefor; and an image-receiving layer for receiving an image in dye by a thermal transfer from a dye donor sheet;

said polymeric cohesively destructible security layer pattern being characterized by a cohesivity less than the adhesivity of such layer for each layer contiguous thereto, said printed security pattern being destroyed by attempted delamination of said image-receiving layer from said image-receiving element.

2. The image-receiving element of claim 1 wherein said printed security pattern upon said attempted delamination is partitioned between respective cohesively failed portions of said destructible layer adhered to each of opposed layers contiguous to said destructible polymeric layer.

3. The image-receiving element of claim 2 wherein said printed security pattern is a fine-line printed pattern in a thickness of from 0.5 to 4$\mu$.

4. The image-receiving element of claim 3 wherein said binder for said patterning agent comprises a polymeric binder having adhesivity for each of said polymeric destructible layer and said image-receiving layer.

5. The image-receiving element of claim 4 wherein said binder comprises hydroxypropylcellulose.

6. The image-receiving element of claim 5 wherein said patterning agent comprises an IR-absorbing dye or a dye which fluoresces under ultraviolet irradiation.

7. The image-receiving element of claim 4 wherein said patterning agent comprises a colored pigment or dye.

8. The image-receiving element of claim 4 wherein said destructible security layer comprises styrenated acrylic polymer.

9. The image-receiving element of claim 8 wherein said image-receiving layer comprises polyvinyl chloride.

10. A method of preparing an identification document secure against tampering and including the steps of:

providing an image-receiving element comprising, in order, a support sheet; a polymeric cohesively destructible security layer having a printed security pattern comprising a patterning agent and a binder therefor; and an image-receiving layer for receiving an image in dye by a thermal transfer from a dye donor sheet; said polymeric cohesively destructible security layer being characterized by a cohesivity less than the adhesivity of such layer for each layer contiguous thereto, and said security pattern being destroyed by attempted delamination of said image-receiving layer from said image-receiving element;

contacting the image-receiving layer of said image-receiving element with a dye donor sheet comprising a support and a thermally transferable dye;

imagewise transferring said dye of said dye donor sheet to the image-receiving layer of said image-receiving element, thereby to provide a dye image-bearing layer; and separating said donor sheet and said image-bearing element from each other.

11. The method of claim 10 wherein said printed security pattern of said image-receiving element, upon said attempted delamination, is partitioned between respective cohesively failed portions of said destructible layer adhered to each of opposed layers contiguous to said destructible polymeric layer.

12. The method of claim 10 wherein said binder for said patterning agent comprises a polymeric binder having adhesivity for each of said polymeric destructible layer and said image-receiving layer.

13. The method of claim 10 wherein said binder comprises hydroxypropylcellulose.

14. The method of claim 13 wherein said patterning agent comprises a colored pigment or dye.

15. The method of claim 14 wherein said patterning agent comprises an IR-absorbing dye or a dye which fluoresces under ultraviolet irradiation.

16. The method of claim 15 wherein said destructible security layer comprises styrenated acrylic polymer.

17. The method of claim 16 wherein said image-receiving layer comprises polyvinyl chloride.

18. The method of claim 10 including the additional step of laminating a protective polymeric layer or sheet to said image-bearing surface.

19. The method of claim 18 wherein said protective polymeric layer or sheet comprises a sheet of polyvinyl chloride.

* * * * *